US010512336B1

(12) United States Patent
Henderson

(10) Patent No.: US 10,512,336 B1
(45) Date of Patent: Dec. 24, 2019

(54) EXERCISE BALL CHAIR

(71) Applicant: James Henderson, Oakland, CA (US)

(72) Inventor: James Henderson, Oakland, CA (US)

( * ) Notice: Subject to any disclaimer, the term of this patent is extended or adjusted under 35 U.S.C. 154(b) by 109 days.

(21) Appl. No.: 15/872,031

(22) Filed: Jan. 16, 2018

(51) Int. Cl.

| | |
|---|---|
| ***A47C 9/00*** | (2006.01) |
| ***A47C 7/54*** | (2006.01) |
| ***A47C 4/54*** | (2006.01) |
| ***A47C 7/00*** | (2006.01) |
| ***A47C 7/42*** | (2006.01) |
| ***A63B 26/00*** | (2006.01) |
| ***A63B 41/00*** | (2006.01) |

(52) U.S. Cl.
CPC ..... *A47C 9/002* (2013.01); *A47C 4/54* (2013.01); *A47C 7/002* (2013.01); *A47C 7/42* (2013.01); *A47C 7/546* (2013.01); *A63B 26/00* (2013.01); *A63B 41/00* (2013.01); *A63B 2210/02* (2013.01); *A63B 2225/62* (2013.01)

(58) Field of Classification Search
CPC .. A47C 9/002; A63B 41/00; A63B 2208/0233
See application file for complete search history.

(56) References Cited

U.S. PATENT DOCUMENTS 4,126,326 A * 11/1978 Phillips ..... A63B 26/003 280/205
6,070,943 A * 6/2000 Guery-Strahm ..... A47C 3/16 297/440.1
6,520,578 B1 * 2/2003 Jospa ..... A61G 15/005 297/217.1
6,616,238 B1 * 9/2003 Guery-Strahm ..... A47C 9/002 297/440.1
7,044,558 B2 5/2006 Chiu
7,118,517 B1 * 10/2006 Hale ..... A63B 21/4015 482/140
7,140,677 B1 11/2006 Chiu
7,588,522 B2 * 9/2009 Heitzman ..... A47C 4/54 297/195.11
8,056,976 B1 * 11/2011 Polk ..... A47C 3/029 297/258.1
D679,916 S 4/2013 Barney
8,721,005 B2 * 5/2014 Mankin ..... A47C 4/54 297/44
9,415,276 B1 8/2016 Hao
9,919,185 B1 * 3/2018 Qiubo ..... A63B 24/0062
2002/0043868 A1 * 4/2002 Glockl ..... A47C 3/027 297/452.1

(Continued)

*Primary Examiner* — David R Dunn
*Assistant Examiner* — Tania Abraham

(57) ABSTRACT

The exercise ball chair stabilizes an exercise ball so that it can be used as a comfortable chair. While seated in the exercise ball chair, a user may perform seated-workout exercises. The exercise ball chair comprises a left support, a right support, and a ball retainer. The ball retainer pivots between a ball retention position and a ball release position. An exercise ball is placed in the chair such that the left support, the right support, and the ball retainer, in the ball retention position, capture the exercise ball and prevent it from rolling. A user may then sit on the exercise ball. A left adjustment knob and a right adjustment knob allow the ball retainer to be locked to prevent it from pivoting. With the adjustment knobs loosened, the ball retainer may be pivoted to the ball release position and the exercise ball may be removed.

13 Claims, 5 Drawing Sheets

(56) References Cited

U.S. PATENT DOCUMENTS

| | | | | |
|---|---|---|---|---|
| 2008/0261789 | A1* | 10/2008 | Hsu | A63B 23/03575 482/140 |
| 2009/0325770 | A1* | 12/2009 | Baschnagel | A63B 21/154 482/142 |
| 2011/0183827 | A1 | 7/2011 | Radi | |
| 2013/0154333 | A1* | 6/2013 | Wu | A47C 4/03 297/452.23 |
| 2016/0345741 | A1 | 12/2016 | Mark | |
| 2017/0120111 | A1 | 5/2017 | McBride | |

* cited by examiner

EXERCISE BALL CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of exercise equipment, more specifically, an exercise ball chair.

SUMMARY OF INVENTION

The exercise ball chair stabilizes an exercise ball so that it can be used as a comfortable chair. While seated in the exercise ball chair, a user may perform seated-workout exercises. The exercise ball chair comprises a left support, a right support, and a ball retainer. The ball retainer pivots between a ball retention position and a ball release position. An exercise ball is placed in the chair such that the left support, the right support, and the ball retainer, in the ball retention position, capture the exercise ball and prevent it from rolling. A user may then sit on the exercise ball. A left adjustment knob and a right adjustment knob allow the ball retainer to be locked to prevent it from pivoting. With the adjustment knobs loosened, the ball retainer may be pivoted to the ball release position and the exercise ball may be removed.

An object of the invention is to retain an exercise ball so that it may be used for seating purposes.

Another object of the invention is to provide a pivoting ball retainer to allow the exercise ball to be removed.

A further object of the invention is to provide adjustment knobs to prevent or allow pivoting of the ball retainer.

These together with additional objects, features and advantages of the exercise ball chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the exercise ball chair in detail, it is to be understood that the exercise ball chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the exercise ball chair.

It is therefore important that the claims be regarded as including such equivalent construction insofar as they do not depart from the spirit and scope of the exercise ball chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
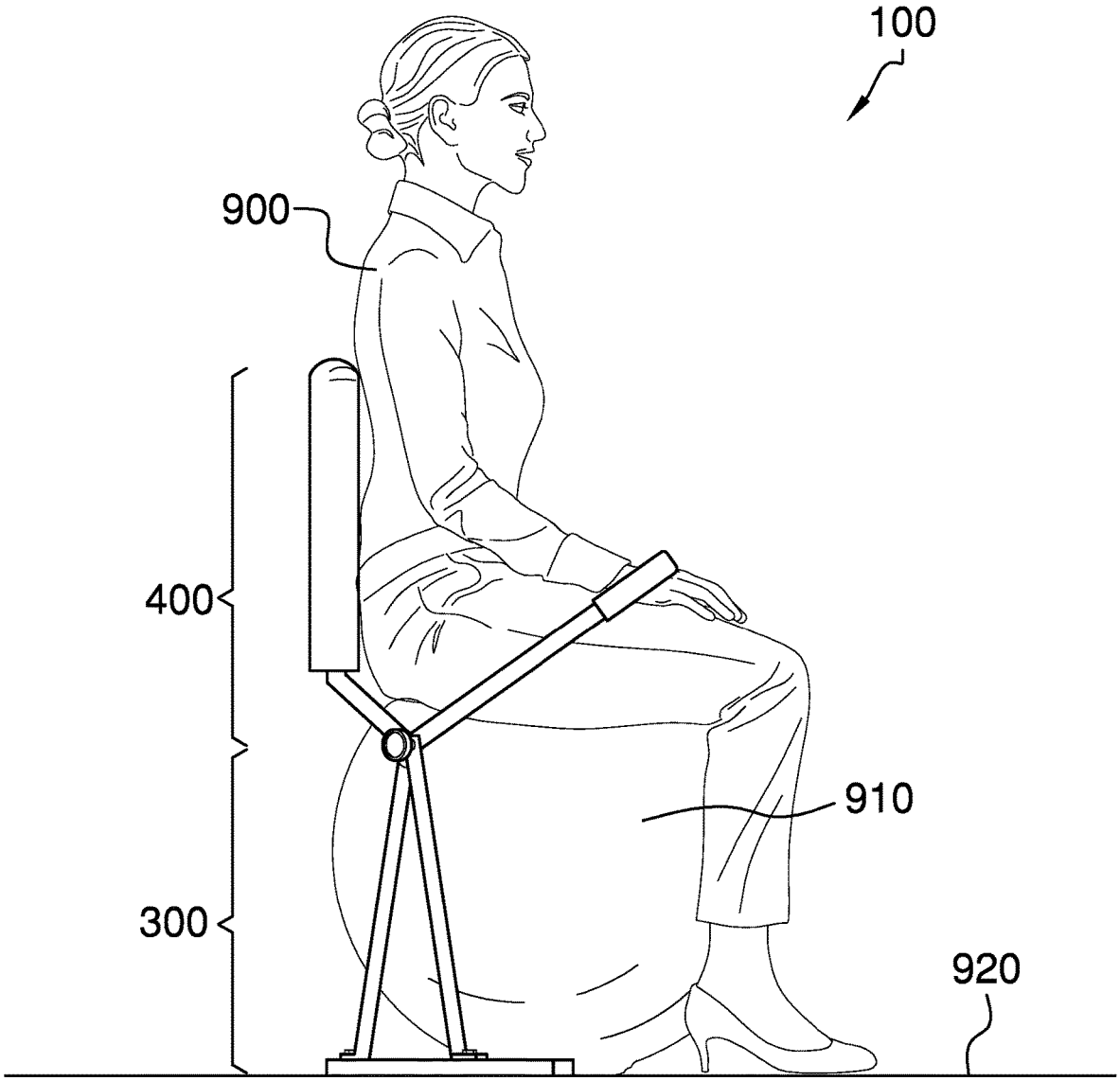
FIG. 1 is an in-use view of an embodiment of the disclosure.
Figure 2:
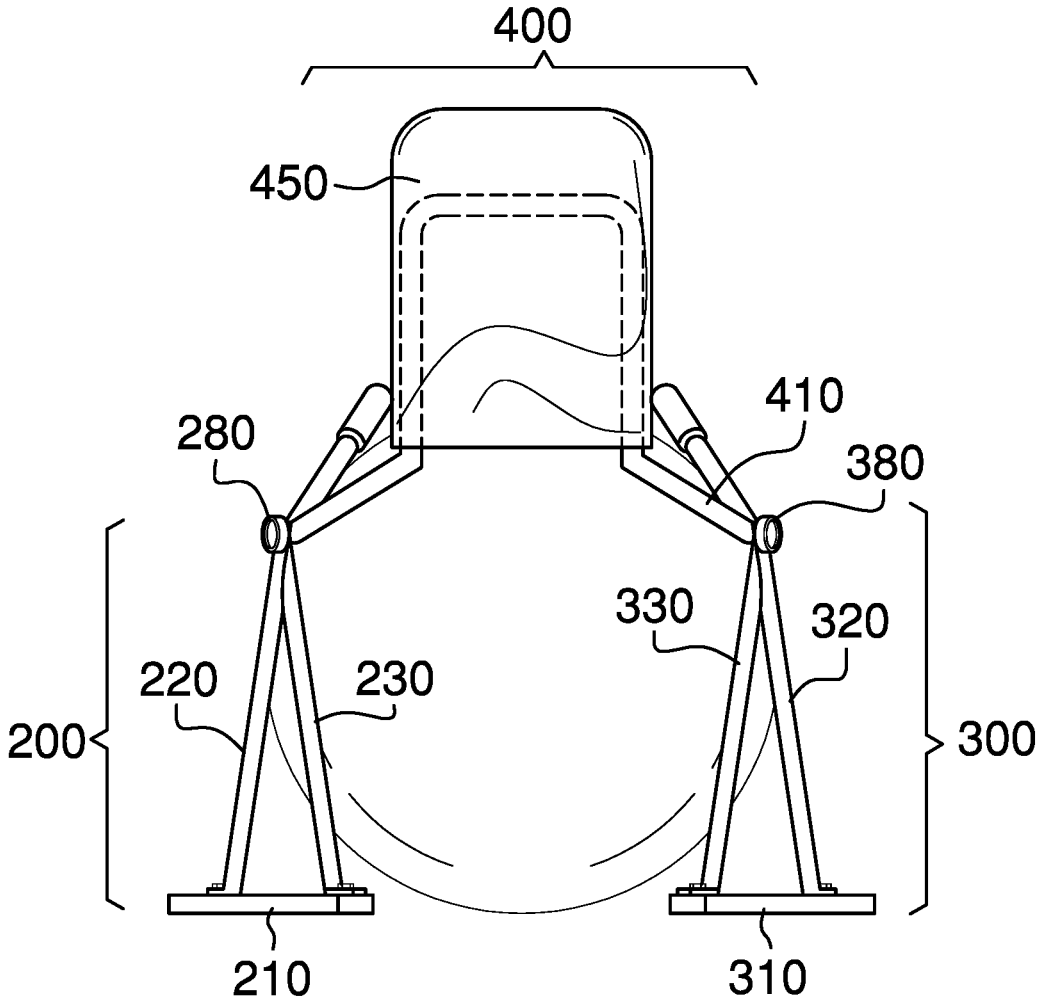
FIG. 2 is a rear view of an embodiment of the disclosure.
Figure 3:
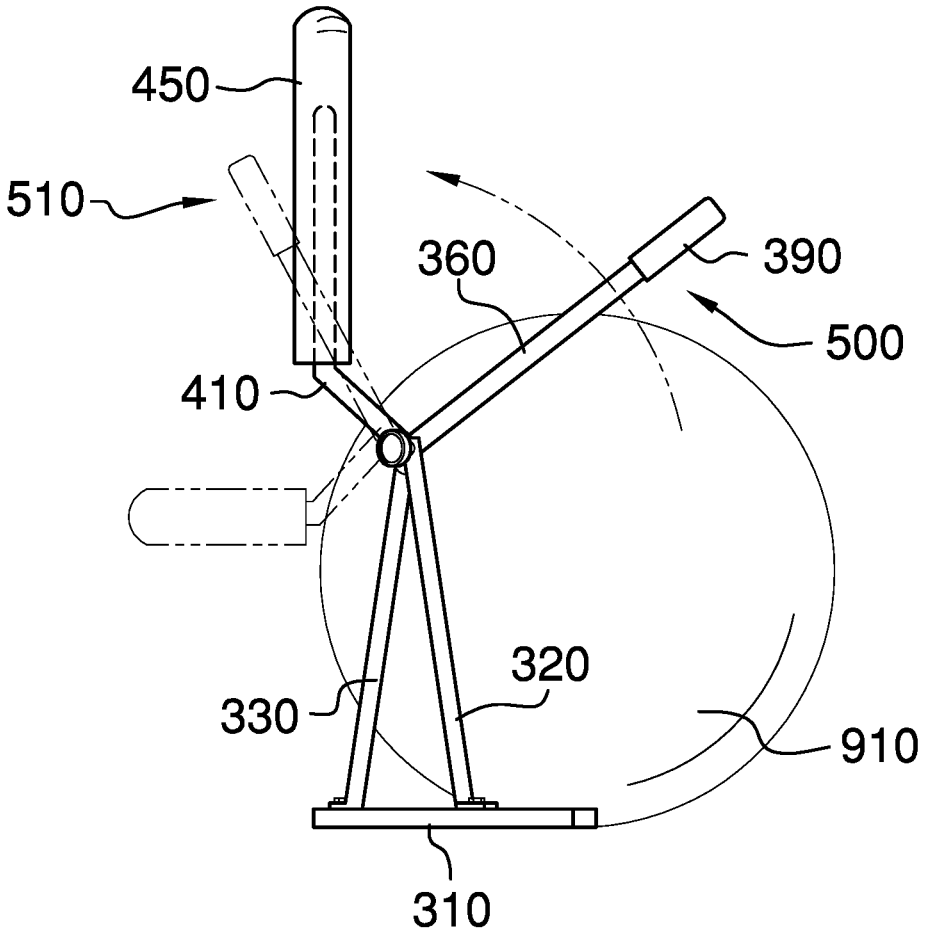
FIG. 3 is a side view of an embodiment of the disclosure.
Figure 4:
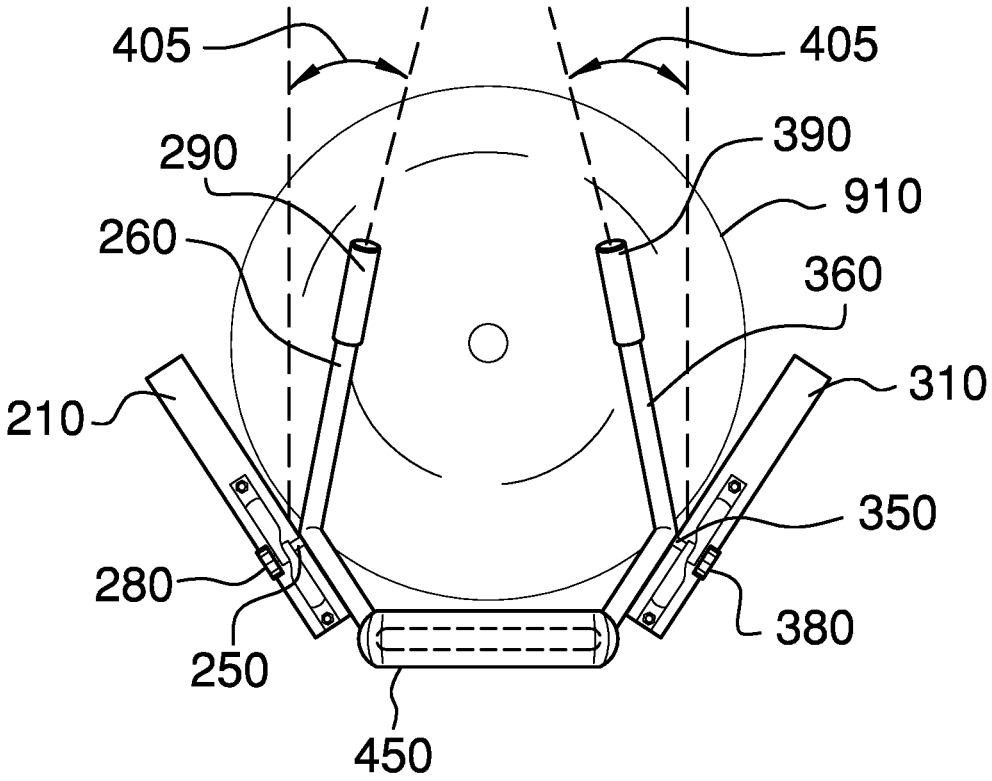
FIG. 4 is a top view of an embodiment of the disclosure.
Figure 5:
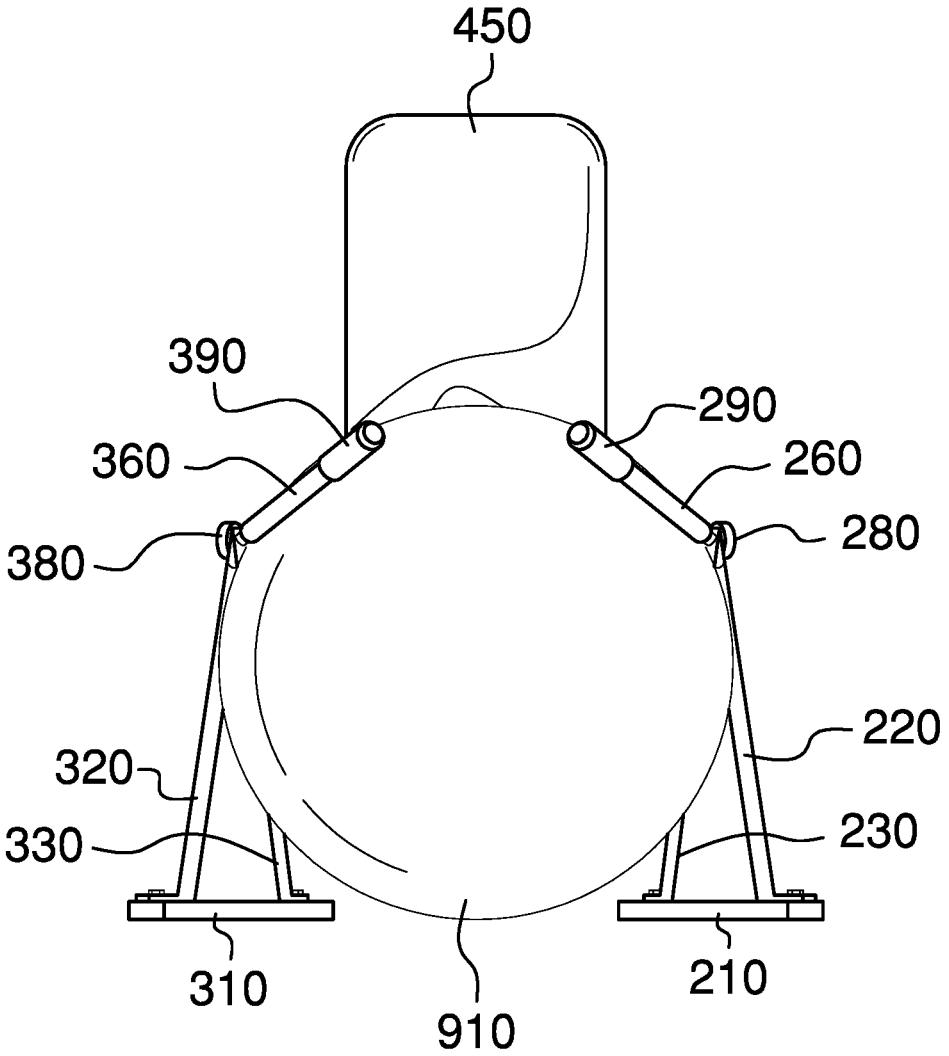
FIG. 5 is a front view of an embodiment of the disclosure.

Detailed reference will now be made to a first potential embodiment of the disclosure, which is illustrated in FIGS. 1 through 5.

The exercise ball chair 100 (hereinafter invention) comprises a left support 200, a right support 300, a ball retainer 400, and a backrest 450. The invention 100 provides stabilization for an exercise ball 910, allowing the exercise ball 910 to be used as a seat. The invention 100 sits on the floor 920 and traps the exercise ball 910, preventing the exercise ball 910 from rolling while a user 900 sits on the exercise ball 910. The invention 100 may be repeatedly removed from the exercise ball 910 and added to the exercise ball 910, thus allowing the exercise ball 910 to be used for exercising purposes not related to the invention 100.

The left support 200 comprises a left base 210, a left front leg 220, and a left rear leg 230. The left base 210 is a horizontal element that rests on the floor 920. The bottom end of the left rear leg 230 attaches to the rear of the left base 210. The bottom end of the left front leg 220 attaches to the left base 210 at a point on the frontmost ½ of the left base 210. The top of the left front leg 220 and the top of the left rear leg 230 attach to each other at the top of the left support 200.

The right support 300 comprises a right base 310, a right front leg 320, and a right rear leg 330. The right base 310 is a horizontal element that rests on the floor 920. The bottom end of the right rear leg 330 attaches to the rear of the right base 310. The bottom end of the right front leg 320 attaches to the right base 310 at a point on the frontmost ½ of the right base 310. The top of the right front leg 320 and the top of the right rear leg 330 attach to each other at the top of the right support 300.

In some embodiments, the left base 210 and the right base 310 may be between 16 and 30 inches in length. When the invention 100 is installed over the exercise ball 910, the distance between the rearmost ends of the left base 210 and the right base 310 may be between 16 and 30 inches.

The ball retainer 400 comprises a left arm 260, a right arm 360, and a backrest support frame 410. The ball retainer 400 may pivot between a ball retention position 500 and a ball release position 510. When the invention 100 is installed on the exercise ball 910 and the ball retainer 400 is in the ball retention position 500, the left arm 260 and the right arm 360 may be oriented in a horizontal direction and the left arm 260, the right arm 360, and the backrest support frame 410 may be in contact with upper surfaces of the exercise ball 910. In this position, the ball retainer 400, in conjunction with contact between the exercise ball 910 by the left support 200 and the right support 300, may prevent movement of the exercise ball 910.

The left arm 260, the right arm 360, and the backrest support frame 410 may be fabricated from a single piece of material. When viewed from overhead while the ball retainer 400 is in the ball retention position 500, the ball retainer 400 may be U-shaped with the front ends of the left arm 260 and the left arm 260 converging towards each other. The left arm 260 and the right arm 360 may each be angled towards the center of the invention 100 by an arm angle 405 measuring between 0 degrees and 45 degrees relative to a parallel arm position.

Between the rear of the left arm 260 and the rear of the right arm 360, the backrest support frame 410 may join the left arm 260 and the right arm 360.

The ball retainer 400 may pivot at a left pivot 250 and a right pivot 350. The left pivot 250 may be located where the rear end of the left arm 260 meets the backrest support frame 410. The right pivot 350 may be located where the rear end of the right arm 360 meets the backrest support frame 410.

In some embodiments, the invention 100 may comprise a plurality of pivot stops (not illustrated in the figures) that prevent the ball retainer 400 from pivoting outside of the range of the ball retention position 500 to the ball release position 510.

The left pivot 250 may comprise a left retainer lock. The left retainer lock may comprise a screw that passes through the ball retainer 400 and the upper end of the left support 200 from the ball side of the ball retainer 400. The left retainer lock may terminate by threading into a left adjustment knob 280. The left adjustment knob 280 may be located on the outside of the ball retainer 400—on the side of the ball retainer 400 that is opposite the exercise ball 910. By turning the left adjustment knob 280 clockwise, the left retainer lock may be tightened and may squeeze the ball retainer 400 and the left support 200 together and this may prevent the ball retainer 400 from pivoting. By turning the left adjustment knob 280 counter-clockwise, the left retainer lock may be loosened and the ball retainer 400 may pivot with respect to the left support 200.

The right pivot 350 may comprise a right retainer lock. The right retainer lock may comprise a screw that passes through the ball retainer 400 and the upper end of the right support 300 from the ball side of the ball retainer 400. The right retainer lock may terminate by threading into a right adjustment knob 380. The right adjustment knob 380 may be located on the outside of the ball retainer 400—on the side of the ball retainer 400 that is opposite the exercise ball 910. By turning the right adjustment knob 380 clockwise, the right retainer lock may be tightened an may squeeze the ball retainer 400 and the right support 300 together and this may prevent the ball retainer 400 from pivoting. By turning the right adjustment knob 380 counter-clockwise, the right retainer lock may be loosened and the ball retainer 400 may pivot with respect to the right support 300.

In some embodiments, the left arm 260 may comprise a left grip 290 and the right arm 360 may comprise a right grip 390. The left grip 290 and the right grip 390 may provided a grasping surface to use when pivoting the ball retainer 400 and may provide friction to hold the exercise ball 910 in place.

The backrest 450 may be a cushion located centrally on the rear side of the invention 100. Specifically, the backrest 450 may be attached to the center of the backrest support frame 410. The backrest 450 may provide a stopping point for rearward movement of the user 900. As a non-limiting example, the backrest 450 may be fabricated from a foam cushion internally and a vinyl or cloth cover surrounding the foam cushion.

In use, the invention 100 is moved to a desired position and orientation and the ball retainer 400 is moved to the ball release position 510. As a non-limiting example, the invention 100 may be placed in front of a window or television with the invention 100 facing the window or television. The exercise ball 910 is placed on the floor 920 within the invention 100 such that the exercise ball 910 is in contact with the left support 200 and the right support 300. The ball retainer 400 is pivoted to the ball release position 510 and the user 900 may sit upon the exercise ball 910. The user 900 tightens the left adjustment knob 280 and the right adjustment knob 380 to prevent movement of the ball retainer 400. While seated on the invention 100, the user 900 may rest and relax or perform seated-workout exercises.

If the exercise ball 910 is needed to perform an exercise not related to the use of the invention 100, the user 900 loosens the left adjustment knob 280 and the right adjustment knob 380 and stands up. The ball retainer 400 is pivoted to the ball retention position 500 and the exercise ball 910 may be removed from the invention 100.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "ball" refers to an object with a spherical or nearly spherical shape.

As used herein, the word "desired" refers to a specific value within a range of supported values. A "desired" value indicates that a range of values is enabled by the invention and that a user of the invention may select a specific value within the supported range of values based upon their own personal preference. As a non-limiting example, for a fan that supports operational speed settings of low, medium, or high, a user may selected a desired fan speed, meaning that the user may select low, medium, or high speed based upon their needs and preferences at the time of the selection.

As used herein, "front" means the side of an object that is closest to a forward direction of travel under normal use of the object or the side or part of an object that normally presents itself to view or that is normally used first. "Rear" or "back' refers to the side that is opposite the front.

As used in this disclosure, a "grip" is a covering that is placed over a hand hold, handle, or shaft.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, "orientation" refers to the positioning and/or angular alignment of a first object relative to a second object or relative to a reference position or reference direction.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An exercise ball chair comprising:

a left support, a right support, a ball retainer, and a backrest;

wherein the exercise ball chair provides stabilization for an exercise ball, allowing the exercise ball to be used as a seat;

wherein the exercise ball chair sits on the floor and traps the exercise ball;

wherein the exercise ball chair is adapted to prevent the exercise ball from rolling while a user sits on the exercise ball;

wherein the left support comprises a left base, a left front leg, and a left rear leg;

wherein the left base is a horizontal element that rests on the floor;

wherein the bottom end of the left rear leg attaches to the rear of the left base;

wherein the bottom end of the left front leg attaches to the left base at a point on the frontmost half of the left base;

wherein the top of the left front leg and the top of the left rear leg attach to each other at the top of the left support;

wherein the right support comprises a right base, a right front leg, and a right rear leg;

wherein the right base is a horizontal element that rests on the floor;

wherein the bottom end of the right rear leg attaches to the rear of the right base;

wherein the bottom end of the right front leg attaches to the right base at a point on the frontmost half of the right base;

wherein the top of the right front leg and the top of the right rear leg attach to each other at the top of the right support;

wherein the ball retainer comprises a left arm, a right arm, and a backrest support frame;

wherein the ball retainer pivots between a ball retention position and a ball release position.

2. The exercise ball chair according to claim 1 wherein the left arm and the right arm are oriented in a horizontal direction when the exercise ball chair is installed on the exercise ball and the ball retainer is in the ball retention position;

wherein the left arm, the right arm, and the backrest support frame are in contact with upper surfaces of the exercise ball when the exercise ball chair is installed on the exercise ball and the ball retainer is in the ball retention position;

wherein the ball retainer, in conjunction with contact between the exercise ball and the left support and the right support, prevents movement of the exercise ball when the exercise ball chair is installed on the exercise ball.

3. The exercise ball chair according to claim 2 wherein the left arm, the right arm, and the backrest support frame are fabricated from a single piece of material;

wherein when viewed from overhead while the ball retainer is in the ball retention position, the ball retainer is U-shaped with the front ends of the left arm and the right arm converging towards each other;

wherein the left arm and the right arm are each angled towards the center of the exercise ball chair by an arm angle measuring between 0 degrees and 45 degrees relative to a parallel arm position.

4. The exercise ball chair according to claim 3 wherein the backrest support frame joins the rear of the left arm to the rear of the right arm.

5. The exercise ball chair according to claim 4 wherein the ball retainer pivots at a left pivot and a right pivot;

wherein the left pivot is located where the rear end of the left arm meets the backrest support frame;

wherein the right pivot is located where the rear end of the right arm meets the backrest support frame.

6. The exercise ball chair according to claim 5 wherein the exercise ball chair comprises a plurality of pivot stops that prevent the ball retainer from pivoting outside of the range of the ball retention position to the ball release position.

7. The exercise ball chair according to claim 5 wherein the left pivot comprises a left retainer lock;

wherein the left retainer lock comprises a screw that passes through the ball retainer and the upper end of the left support from the ball side of the ball retainer;

wherein the left retainer lock terminates by threading into a left adjustment knob.

8. The exercise ball chair according to claim 7 wherein the left adjustment knob is located on the outside of the ball retainer;

wherein by turning the left adjustment knob clockwise, the left retainer lock is tightened and squeezes the ball retainer and the left support together to prevent the ball retainer from pivoting;

wherein by turning the left adjustment knob counter-clockwise, the left retainer lock is loosened and the ball retainer pivots with respect to the left support.

9. The exercise ball chair according to claim 8 wherein the right pivot comprises a right retainer lock;

wherein the right retainer lock comprises a screw that passes through the ball retainer and the upper end of the right support from the ball side of the ball retainer;

wherein the right retainer lock terminates by threading into a right adjustment knob.

10. The exercise ball chair according to claim 9 wherein the right adjustment knob is located on the outside of the ball retainer;

wherein by turning the right adjustment knob clockwise, the right retainer lock is tightened and squeezes the ball retainer and the right support together to prevent the ball retainer from pivoting;

wherein by turning the right adjustment knob counter-clockwise, the right retainer lock is loosened and the ball retainer pivots with respect to the right support.

11. The exercise ball chair according to claim 10 wherein the left arm comprises a left grip;

wherein the right arm comprises a right grip;

wherein the left grip and the right grip provide a grasping surface to use when pivoting the ball retainer and provides friction to hold the exercise ball in place.

12. The exercise ball chair according to claim 10 wherein the backrest is a cushion located centrally on the rear side of the exercise ball chair;

wherein specifically, the backrest is attached to the center of the backrest support frame;

wherein the backrest is adapted to provide a stopping point for rearward movement of the user.

13. The exercise ball chair according to claim 12 wherein the backrest is fabricated from a foam cushion internally and a vinyl or cloth cover surrounding the foam cushion.

* * * * *